US011988119B1

(12) United States Patent
Smith et al.

(10) Patent No.: US 11,988,119 B1
(45) Date of Patent: May 21, 2024

(54) INTERNAL COMBUSTION ENGINE WITH VENTILATION SYSTEM FOR CRANKCASE DILUTION

(71) Applicant: Caterpillar Inc., Peoria, IL (US)

(72) Inventors: Lucas K. Smith, Lafayette, IN (US); Rodney Allen Lawrence, Frankfort, IN (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 18/200,328

(22) Filed: May 22, 2023

(51) Int. Cl.
*F01M 13/02* (2006.01)
*F01M 13/00* (2006.01)

(52) U.S. Cl.
CPC ... *F01M 13/028* (2013.01); *F01M 2013/0038* (2013.01)

(58) Field of Classification Search
CPC ..... F01M 13/028; F01M 2013/0038
See application file for complete search history.

(56) References Cited

U.S. PATENT DOCUMENTS

| | | | | |
|---|---|---|---|---|
| 2,736,307 | A | 2/1956 | Wilcox | |
| 3,418,986 | A | 12/1968 | Scherenberg | |
| 8,695,339 | B2 | 4/2014 | Spix | |
| 9,593,605 | B2 | 3/2017 | Ulrey et al. | |
| 9,771,841 | B2 | 9/2017 | Newman et al. | |
| 9,909,470 | B2 | 3/2018 | Christian et al. | |
| 10,174,650 | B2 | 1/2019 | Newman et al. | |
| 2011/0030659 | A1* | 2/2011 | Ulrey | F02M 25/089 123/521 |

* cited by examiner

*Primary Examiner* — Kevin A Lathers
(74) *Attorney, Agent, or Firm* — Schwegman Lundberg & Woessner, P.A.

(57) ABSTRACT

Apparatuses, systems and methods are disclosed including an internal combustion engine. The internal combustion engine can include an engine block defining a combustion chamber and a crankcase in fluid communication with the combustion chamber. The internal combustion engine can include an auxiliary device in fluid communication with the crankcase of the engine block. The auxiliary device is driven by the internal combustion engine to supply air to the crankcase of the engine block at a desired pressure range and a desired mass flow rate range to ventilate the crankcase.

20 Claims, 4 Drawing Sheets

INTERNAL COMBUSTION ENGINE WITH VENTILATION SYSTEM FOR CRANKCASE DILUTION

TECHNICAL FIELD

The present disclosure relates to internal combustion engines such as those for vehicles or stationary power generation. More particularly, the present disclosure relates to internal combustion engines having an engine powered ventilation system for diluting un-combusted fumes, blow-by constituents and/or aerosolized oil within a crankcase.

BACKGROUND

Machinery, for example, agricultural, industrial, construction or other heavy machinery can be propelled by an internal combustion engine(s). Internal combustion engines can be used for other purposes such as for power generation. Internal combustion engines combust a mixture of air and fuel in cylinders and thereby produce drive torque and power. A portion of the combustion gases (termed "blow-by") may escape the combustion chamber past the piston and enter undesirable areas of the engine such as the crankcase, which houses the crankshaft of the engine. Blow-by can contain hydrogen (an explosive gas) and potentially corrosive chemicals such as hydrogen sulfide and hydrogen sulfide biproducts like sulfur dioxide. In rare cases, un-combusted fuel and/or explosive gases can build within the engine such as within the crankcase. The un-combusted fuel and/or explosive gases can result in an explosion if not properly mitigated such as by dilution. Crankcase ventilation systems are known in combustion engines to vent blow-by gases within the crankcase. For example, U.S. Pat. Nos. 3,418,986 and 9,909,470 disclose examples of a crankcase ventilation systems. However, U.S. Pat. Nos. 3,418,986 and 9,909,470 provide a compressor driven by a turbine powered by combustion products leaving the combustion chamber along an exhaust manifold.

SUMMARY

In an example according to this disclosure, an internal combustion engine is disclosed. The internal combustion engine can include an engine block defining a combustion chamber and a crankcase in fluid communication with the combustion chamber. The internal combustion engine can include an auxiliary device in fluid communication with the crankcase of the engine block. The auxiliary device is driven by the internal combustion engine to supply air to the crankcase of the engine block at a desired pressure range and a desired mass flow rate range to ventilate the crankcase.

In another example according to this disclosure, a method of diluting products of combustion within a crankcase of an internal combustion engine is disclosed. The method can include drawing air from an ambient source and supplying air having a desired pressure range and a desired mass flow rate range with an auxiliary device driven by the internal combustion engine to the crankcase of the internal combustion engine.

In yet another example according to this disclosure, a ventilation system for supplying air to a crankcase of an internal combustion engine is disclosed. The system can optionally include an engine block defining a combustion chamber and the crankcase in fluid communication with the combustion chamber, an inlet configured to filter air from an ambient source and an auxiliary device in fluid communication with the inlet and the crankcase of the engine block. The auxiliary device can be driven by the internal combustion engine to supply the air from the ambient source and provide the air to the crankcase of the engine block at a desired pressure range and a desired mass flow rate range to ventilate the crankcase.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Examples according to this disclosure are directed to internal combustion engines, and to systems and methods for supplying air to the internal combustion engine to dilute un-combusted fumes, blow-by constituents and/or aerosolized oil within the engine. Examples of the present disclosure are now described with reference to the accompanying drawings. The following description is merely exemplary in nature and is not intended to limit the present disclosure, application, or use. Examples described set forth specific components, devices, and methods, to provide an understanding of embodiments of the present disclosure. It will be apparent to those skilled in the art that specific details need not be employed and that examples may be embodied in many different forms. Thus, the examples provided should not be construed to limit the scope of the claims.

As used herein, the terms "comprises," "comprising," "having," including," or other variations thereof, are intended to cover a non-exclusive inclusion such that a process, method, article, or apparatus that comprises a list of elements does not include only those elements, but may include other elements not expressly listed or inherent to such a process, method, article, or apparatus. Further, relative terms, such as, for example, "about," "substantially," "generally," and "approximately" are used to indicate a possible variation of ±10% in a stated value.

Figure 1:
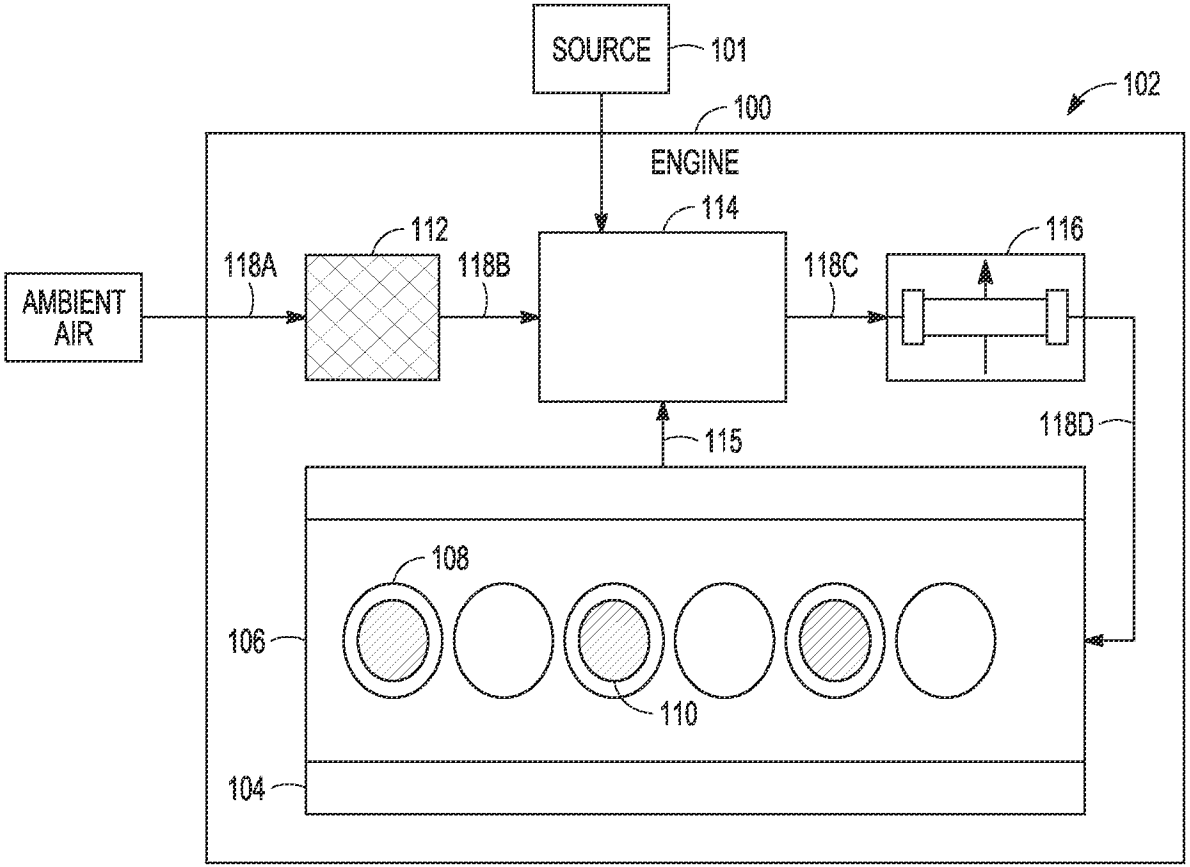
FIG. 1 is a schematic illustration depicting an example internal combustion engine including an exemplary ventilation system in accordance with an example of this disclosure.

FIG. 1 depicts an example schematic illustration of an internal combustion engine 100 (sometimes referred to as "engine" herein for simplicity) in accordance with this disclosure. The engine 100 can be used for power generation such as for the propulsion of vehicles or other machinery or for stationary power generation. The engine 100 can include various power generation platforms, and can use fuel including, for example, gasoline, gaseous fuel, diesel or blends thereof. Stationary engines may be used to drive immobile equipment, such as pumps, generators, mills, or factory equipment. In one embodiment, the engine 100 can be used in landfill applications for generating electricity. As such, the engine 100 may employ gaseous fuel. As used herein, "gaseous fuel" may include fuel that is supplied to the engine 100 in gaseous form and can include, for example, propane, natural gas, gas associated with natural gas such as bio-gas, landfill gas, carbon monoxide, hydrogen, hydrogen sulfide, or mixtures thereof. The fuel may have different levels of purity. As used herein, natural gas refers to both pure and relatively impure forms having various amounts of methane and other constituents. It is understood that the present disclosure can apply to any number of piston-cylinder arrangements and a variety of engine configurations including, but not limited to, V-engines, inline engines, and horizontally opposed engines, as well as overhead cam and cam-in-block configurations.

In some applications, the internal combustion engines disclosed here are contemplated for use in gas compression. The internal combustion engines can employ a low pressure fuel delivery system where fuel is introduced at a turbocharger/compressor inlet. Thus, the fuel can be mixed all the way through the engine. The internal combustion engine 100 can be used in stationary applications as discussed above but also can be used with vehicles and machinery that include those related to various industries, including, as examples, construction, agriculture, forestry, transportation, material handling, waste management, etc.

The engine 100 can include an on-engine or off-engine (or partially on-engine and partially off-engine) ventilation system 102. Additionally, the engine 100 can include an engine block 104, a crankcase 106, combustion chambers 108 and breathers 110. The ventilation system 102 can include an air filter 112, an auxiliary device 114 and a heat exchanger 116.

The ventilation system 102 can include passages 118A, 118B, 118C and 118D that allow for fluid communication between the air filter 112, the auxiliary device 114 and the heat exchanger 116. Although not illustrated in FIG. 1, it is recognized that the ventilation system 102 can include valves or other regulators configured to prevent reverse flow when the pressure along the passages 118C and 118D or within the auxiliary device 114 and/or the heat exchanger 116 is lower than the pressure within the crankcase 106. However, valves or regulators are not required in all examples as operational criteria such as loads and pressure levels dictate. The terms "passage", "passages", "passageway", "passageways", "line" or "lines" as used herein should be interpreted broadly. These terms can be features defined by the various components of the engine illustrated in the FIGURES or can be formed by additional components (e.g., a hose, tube, pipe, manifold, cavity etc.) as known in the art.

In the example of FIG. 1, the ventilation system 102 can be part of the engine 100 and the components thereof including the auxiliary device 114 are mounted thereto. The ventilation system 102 can be part of the original manufacture of the engine 100 or can be a retrofitted system that is added to the engine 100 during maintenance, upgrade or the like. The ventilation system 102 can be in fluid communication with the crankcase 106 such as via the passages 118A, 118B, 118C and 118D. The ventilation system 102 can be configured to supply ambient air to the crankcase 106 and any other components (not show) that are directly in fluid communication with the crankcase 106.

During operation of engine 100, blow-by gases may leak into crankcase 106. As used herein, blow-by gas may include leakage of air, fuel, combustion gases and/or a mixture thereof. The air the ventilation system 102 supplies can act to ventilate the crankcase 106 and other components. This ventilation can dilute un-combusted fuel, explosive gases and/or volatiles such as found in the blow-by gas and/or fuel below a lower explosive limit so as to prevent or reduce the likelihood of an explosion within the engine 100. Additionally, dilution can reduce corrosion due to reducing the concentration of hydrogen sulfide, for example. The un-combusted fuel, explosive gases, other volatiles and air including air provided by the ventilation system are collectively referred to herein as "fumes" in some cases for simplicity.

Ambient air for the ventilation system 102 can be collected at an intake and passed along the passage 118A to the air filter 112 to be appropriately cleaned. The air for the intake can be obtained from atmosphere or another source. The air can then pass along the passage 118B to the auxiliary device 114. The auxiliary device 114 can be, for example, a supercharger, turbocharger, compressor, or other device configured to supply air having a desired pressure range and a desired mass flow rate range to the engine 100. The auxiliary device 114 can be driven 115 by fluid of the engine 100, off-engine fluid or a combination of on-engine fluid and off-engine fluid to supply the air to the crankcase 106. The off-engine fluid can be from a source 101. In some instances, supplying the air can include the auxiliary device 114 compressing the air to a compressed air that is supplied to the crankcase 106 of the engine 100. To reiterate, driving the auxiliary device can be accomplished by using fluid(s) of the engine 100 (e.g., on-engine fluid such as a boost air, lube oil, coolant, etc.). The air leaving the auxiliary device 114 can be provided to the crankcase 106 via the passages 118C and 118D passing through the heat exchanger 116, for example.

As an example, the desired pressure range for the air can be between about 0 kPa-g and about 35 kPa-g (about 5 psi). According to further examples, the desired pressure range can be between about 0 kPa-g and about 17.5 kPa-g (about 2.5 psi). In yet further examples, the desired pressure range can be between about 0 kPa-g and about 7 kPa-g (about 1 psi). The desired mass flow rate range can between about 10 kg/hour and about 300 kg/hour. According to further examples, the desired mass flow rate range can be between about 10 kg/hour and about 200 kg/hour. In yet further examples, the desired mass flow rate range can be between about 10 kg/hour and about 50 kg/hour. However, other ranges for the desired pressure range and the desired mass flow rate range are contemplated. The mass flow rate range should be sufficient to keep volatiles within sensitive areas such as the crankcase 106 below a lower explosive limit (typically a fuel percentage by volume below 5%). The mass flow rate should not be excessive to avoid the potential for high crankcase pressure. It should be noted that unlike typical auxiliary systems that use devices such as superchargers, turbochargers, compressors, etc. employed with internal combustion systems, the ventilation system 102 provides a lower pressure and higher mass flow rate to the crankcase 106. This is in contrast to typical auxiliary engine systems, which supply a higher pressure and lower mass flow rate air for auxiliary or other engine related purposes.

The air can pass from the auxiliary device 114 along the passage 118C to the heat exchanger 116. The heat exchanger 116 can be an aftercooler or another type of air-to-air or liquid-to-air heat exchanger as known in the art. The heat exchanger 116 can be configured to receive and cool the air to a desired temperature range. The desired temperature range can be between about 80 degrees Celsius and about 120 degrees Celsius, for example. A heat exchanger is not contemplated in all examples. From the heat exchanger 116, the air passes along the passage 118D to the crankcase 106 such as via an intake manifold or other suitable connection.

The engine block 104 can comprise a housing and can form the crankcase 106, combustion chambers 108, and other features not specifically illustrated in FIG. 1. The combustion chambers 108 can be cylinders, cylinder heads or other shaped features as known in the art. The combustion chambers 108 can be configured to house one or more pistons (not shown) therein. Each piston can be reciprocally moveable within the combustion chamber 108 and can be coupled to a shaft (not shown) within the crankcase 106. Movement of the shaft can facilitate a reciprocal movement of the piston within the combustion chamber 108.

The breathers 110 can couple directly or indirectly to the engine block 104uch as at a valve cover, rocker box, or the like, and can be in fluid communication with the combustion chamber 108 and/or the crankcase 106. Each of the breathers 110 can comprise a mechanism that separates the oil droplets and oil mist from the blow-by gas in order to prevent the oil droplets and oil mist contained in the blow-by gas from being taken out along the flow of the blow-by gas. By way of example, the breathers 110 can include one or more separation mechanisms such as an oil separation valve, splasher plate, serpentine passage, mesh or other obstruction. The breathers 110 can be an outlet allowing passage of fumes, blow-by constituents and/or aerosolized oil to atmosphere or another location such as away from the engine 100.

Figure 2:
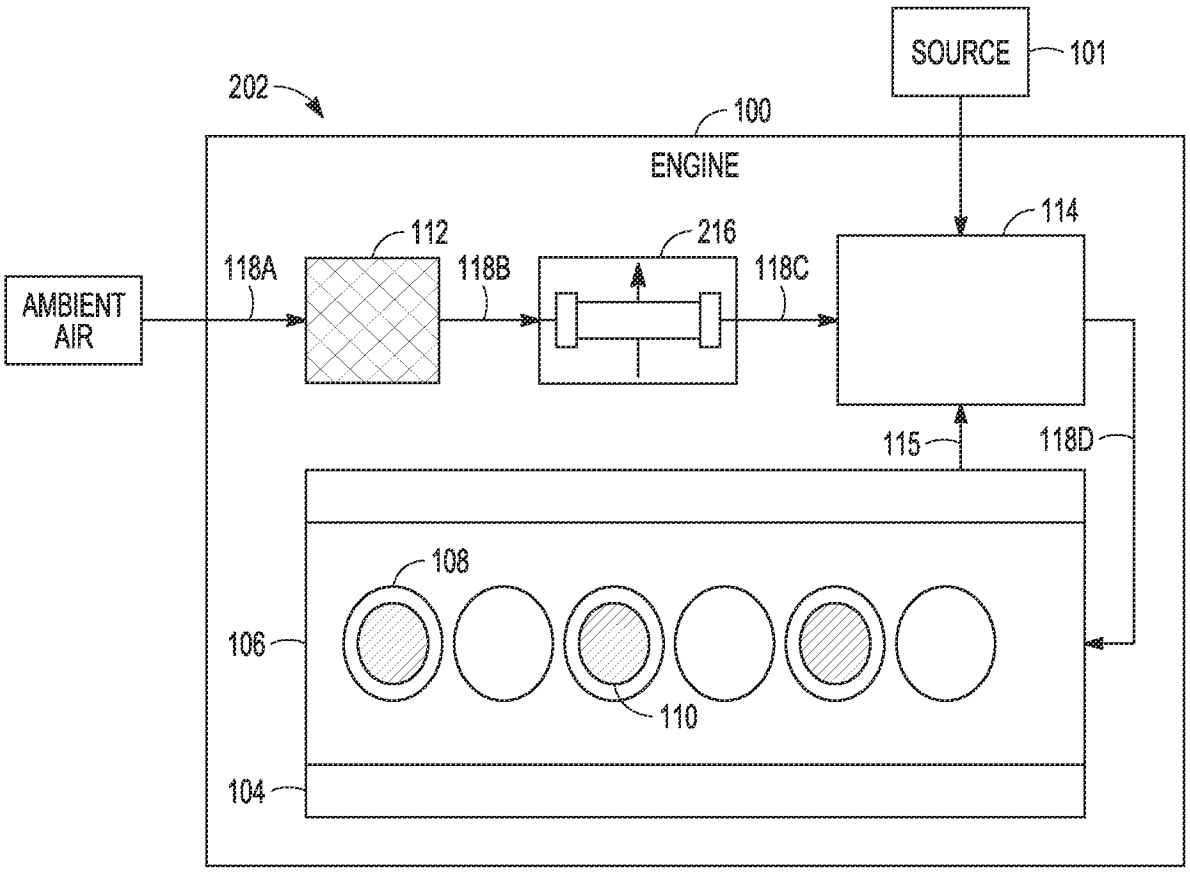
FIG. 2 is a second schematic illustration of the internal combustion engine with a ventilation system including an auxiliary device, air filter and heat exchanger in accordance with an example of this disclosure.

FIG. 2 is a schematic illustration of the engine 100 with another example of a ventilation system 202. The engine 200 and the ventilation system 202 can be configured in and operate in the manner of the engine 100 and the ventilation system 102 discussed previously. However, the ventilation system 202 differs in that the ventilation system 202 has the heat exchanger 216 located before the auxiliary device 114 such that the heat exchanger 216 receives ambient or filtered air, heats or cools the air and passes the heated or cooled air to the auxiliary device 114 at a desired temperature range.

Figure 3:
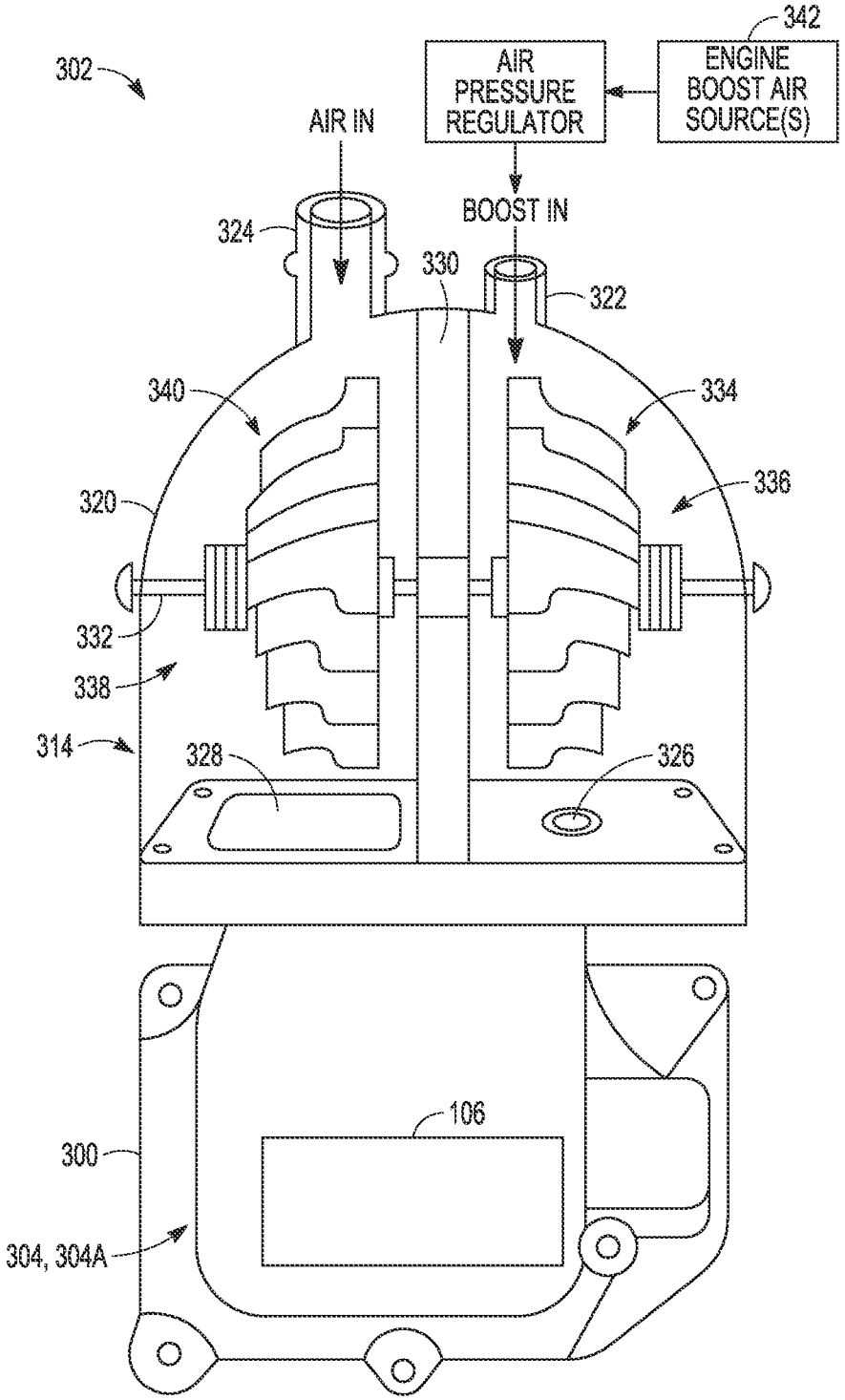
FIG. 3 is an illustration of an auxiliary device that can be used with the ventilation system, the auxiliary device including a turbine wheel and a compressor wheel driven by boost air of the internal combustion engine in accordance with an example of this disclosure.

FIG. 3 illustrates an auxiliary device 314 that can be part of a ventilation system 302. The auxiliary device 314 can be mounted to an engine block 304 such as at a breather support 304A, valve cover or other part of an engine 300. The auxiliary device 314 can include a housing 320, a first inlet 322, a second inlet 324, a first outlet 326, a second outlet 328, a partition wall 330, a shaft 332, a first compressor or turbine wheel 334, a first chamber 336, a second chamber 338 and a second compressor or turbine wheel 340.

The housing 320 can enclose the components of the auxiliary device 314 and can be configured to mount on the engine block 304 such as on the cam gallery. The housing 320 can comprise a casting or other wall and can include the partition wall 330, which separates the auxiliary device 314 into the two separate chambers 336 and 338. The first inlet 322 and the first outlet 326 allow for fluid communication into and out of the first chamber 336. The first compressor or turbine wheel 334 can be located in the first chamber 336 and can be coupled to the shaft 332. The shaft 332 can extend through the partition wall 330 and can be coupled to the second compressor or turbine wheel 340. The partition wall 330 can include a bearing system within the partition wall to support the shaft 332. The bearing system can be configured to minimize rotational friction (torque loss). A sealing system between the first chamber 336 (high pressure) and second chamber 338 (low pressure) can be part of the partition wall 330 to control leakage from one chamber to the next. The shaft 332 can connect to both the first compressor or turbine wheel 334 and the second compressor or turbine wheel 340. The second compressor or turbine wheel 340 can be located in the second chamber 338. The second inlet 324 and the second outlet 328 allow for fluid communication into and out of the second chamber 338.

The auxiliary device 314 can be configured to receive a fluid such as engine boost air at the first inlet 322 allowing the boost air to pass into the first chamber 336. The boost air can be provided by a turbocharger, compressor or other component of the engine 300 indicated as source 342 in FIG. 3. The boost air can be mixed with cooled air from an aftercooler, in some examples. The boost air can act to rotate the first compressor or turbine wheel 334 on shaft 332, and thereby, rotate the second compressor or turbine wheel 340 via the shaft 332. The boost air can exit the first outlet 326 and can be routed back to the engine 300 or to other auxiliary components for additional purposes.

The second compressor or turbine wheel 340 when rotated can draw ambient air through the second inlet 324 into the second chamber 338. Prior to entering the second chamber 338, the ambient air can be filtered as discussed previously with regard to FIG. 1. Within the second chamber 338, the ambient air can be compressed to the compressed air having the desired pressure range and the desired mass flow rate range by the action of the second compressor or turbine wheel 340. The compressed air can pass from the second chamber 338 via the second outlet 328 and can be passed into the crankcase 106 of the engine 300. Although not shown, a heat exchanger such as those illustrated in FIG. 1 or 2 can be used to heat or cool the air to the desired temperature range according to some examples.

Figure 4:
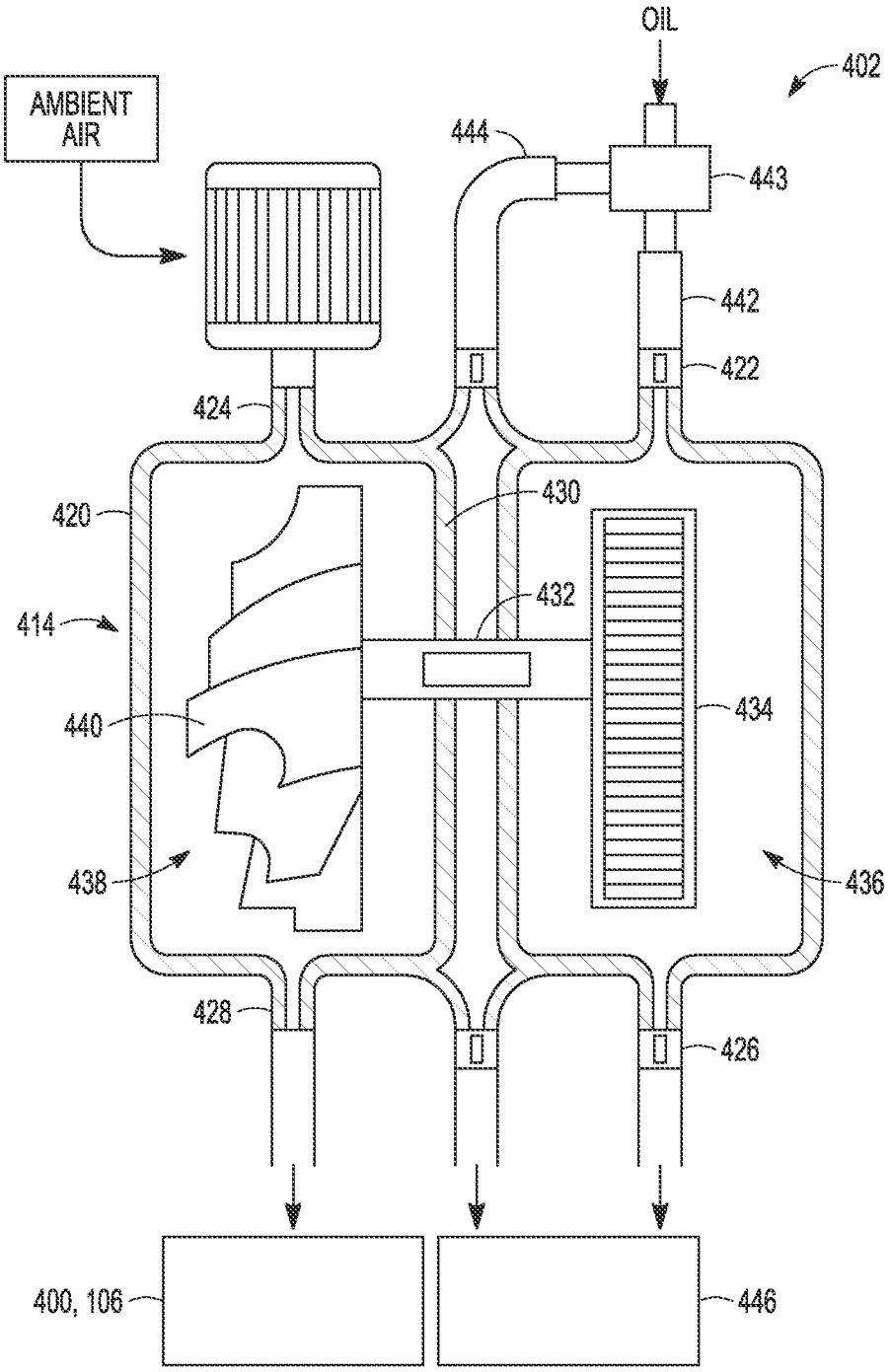
FIG. 4 is an illustration of an auxiliary device that can be used with the ventilation system, the auxiliary device including a component such as a gear or wheel and a compressor wheel driven by lube oil of the internal combustion engine in accordance with an example of this disclosure.

FIG. 4 illustrates an auxiliary device 414 that is part of a ventilation system 402. The auxiliary device 414 can be similar to that of the auxiliary device 314 of FIG. 3. The auxiliary device 414 can be off-engine or can be on-engine such as mounted to the engine block (not shown) in a manner similar to the auxiliary device 314. The auxiliary device 414 can include a housing 420, a first inlet 422, a second inlet 424, a first outlet 426, a second outlet 428, a partition wall(s) 430, a shaft 432, a component 434, a first chamber 436, a second chamber 438 and a compressor or turbine wheel 440. Additionally, the ventilation system 402 can include a flow distribution block 443 and passages 442 and 444.

The housing 420 can enclose the components of the auxiliary device 414. The housing 420 can comprise a casting or other wall and can include the partition walls 430, which separate the auxiliary device 414 into the two separate chambers 436 and 438. The partition walls 430 can additionally be configured to form part or all of the passage 444 as further discussed subsequently. The first inlet 422 and the first outlet 426 allow for fluid communication with the first chamber 436. The component 434 such as a gear, wheel or other component can be located in the first chamber 436 and can be coupled to the shaft 432. The shaft 432 can extend through the partition wall(s) 430 and can be coupled to the compressor or turbine wheel 440. The shaft 432 can connect to both the component 434 and the compressor or turbine wheel 440. The compressor or turbine wheel 440 can be located in the second chamber 438. The second inlet 424 and the second outlet 428 allow for fluid communication into and out of the second chamber 438.

The auxiliary device 414 can be configured to receive a fluid such as engine lube oil via the passages 442 and/or 444. The passage 442 can be coupled to and can be in fluid communication with the first inlet 422 allowing the lube oil to pass into the first chamber 436. The lube oil can be provided by oil pump, oil sump, oil pan and/or other components of the engine 400 indicated as source 446 in FIG. 3 or from an off-engine source such as source shown in FIG. 1. The lube oil can act to rotate the component 434 on shaft 432 and rotate the compressor or turbine wheel 440 via the shaft 432. The lube oil can exit the first outlet 426 and can be routed back to the engine 400 such as to the source 446 or to other auxiliary components for additional purposes.

The flow distribution block 443 can split the flow of the lube oil to the first inlet 422 by regulating oil flow along the passages 442 and 444. The passage 444 can be a bypass passage from the first chamber 436 and the second chamber 438 being between the partition walls 430. The flow distribution block 443 can operate/be configured to direct a desired amount of flow of oil into the first chamber 436 along the passage 442 to increase or slow the rotation of the component 434 on the shaft 432 as desired, for example.

The compressor or turbine wheel 440 when rotated can draw ambient air through the second inlet 424 into the second chamber 438. Prior to entering the second chamber 438, the ambient air can be filtered as discussed previously with regard to FIG. 1. Within the second chamber 438, the ambient air can be compressed to the compressed air having the desired pressure range and the desired mass flow rate range by the action of the compressor or turbine wheel 440. The air can pass from the second chamber 438 via the second outlet 428 and can be passed into the crankcase 106 of the engine 400. Although not shown, a heat exchanger such as those illustrated in FIG. 1 or 2 can be used to heat or cool the air to the desired temperature range according to some examples.

INDUSTRIAL APPLICABILITY

In operation, the engine 100, 200, 300 or 400 can be configured to combust fuel to generate power. While typically efficient, a small portion of the blow-by gases may escape the combustion chamber past the piston and enter undesirable areas of the engine such as the crankcase 106. The present disclosure contemplates ventilation systems 102, 202, 302 or 402 can be in fluid communication with the crankcase 106 and can be driven by the engine 100, 200, 300 or 400 (e.g., via fluid such as lube oil, boost air or coolant) and/or by off-engine fluid. The ventilation systems 102, 202, 302 or 402 can be configured to supply air to the crankcase 106 and other components of the engine with a desired pressure range and a desired mass flow rate range. The air of the ventilation system 102, 202, 302, 402 supplies can act to ventilate or purge the crankcase 106 and other components. This ventilation can dilute fumes (un-combusted fuel, explosive gases and/or volatiles) below the lower explosive limit so as to prevent or reduce the likelihood of an explosion within the engine 100, 200, 300 and 400. Other benefits include reducing the concentration of hydrogen sulfide, which if too concentrated can cause engine corrosion and oil fouling.

The present ventilation systems 102, 202, 302 or 402 rely on the engine 100, 200, 300 or 400 to provide operative drive to the auxiliary device 114, 214, 314 or 414. This can improve efficiency as the driving leverages existing engine components such as a lube oil, coolant and/or boost air of the engine 100, 200, 300 or 400. The present ventilation systems 102, 202, 302 or 402 are configured to provide the air to the crankcase 106 at the desired pressure range and the desired mass flow rate range. Unlike many existing engine systems that utilize air at a higher pressure and lower mass flow rate, the ventilation systems 102, 202, 302 or 402 can supply the air at a lower pressure and higher mass flow rate. This can be advantageous in providing sufficient mass flow rate to keep the fumes within the crankcase below lower explosive limit while avoiding unwanted high pressure within the crankcase. High pressure within the crankcase can lead to pressure spikes and other unwanted and potentially damaging pressure related outcomes within the engine.

The above detailed description is intended to be illustrative, and not restrictive. The scope of the disclosure should, therefore, be determined with references to the appended claims, along with the full scope of equivalents to which such claims are entitled.

What is claimed is:

1. An internal combustion engine comprising:

an engine block defining a combustion chamber and a crankcase in fluid communication with the combustion chamber;

an auxiliary device in fluid communication with the crankcase of the engine block, wherein the auxiliary device is driven by the internal combustion engine to supply air to the crankcase of the engine block at a desired pressure range and a desired mass flow rate range to ventilate the crankcase, wherein the auxiliary device includes a gear or wheel that is driven by a boost air from the internal combustion engine.

2. The internal combustion engine of claim 1, wherein the auxiliary device includes a second wheel coupled to the wheel and rotated thereby to compress the air from an ambient source.

3. The internal combustion engine of claim 1, wherein the desired pressure range is between 0 kPa-g and about 35 kPa-g and the desired mass flow rate range is between about 10 kg/hour and about 300 kg/hour.

4. The internal combustion engine of claim 1, wherein the auxiliary device is mounted to the internal combustion engine, and wherein the air is passed through a heat exchanger prior to the air entering the crankcase.

5. The internal combustion engine of claim 1, further comprising a heat exchanger, wherein one of: the heat exchanger receives the air from the auxiliary device prior to the air entering the crankcase or the heat exchanger receives the air from ambient and passes the air to the auxiliary device.

6. An internal combustion engine comprising:

an engine block defining a combustion chamber and a crankcase in fluid communication with the combustion chamber;

an auxiliary device in fluid communication with the crankcase of the engine block, wherein the auxiliary device is driven by the internal combustion engine to supply air to the crankcase of the engine block at a desired pressure range and a desired mass flow rate range to ventilate the crankcase, wherein the auxiliary device includes a component that is driven by a lube oil of the internal combustion engine.

7. The internal combustion engine of claim 6, wherein the auxiliary device includes a wheel coupled to the component and rotated thereby to compress the air from an ambient source.

8. The internal combustion engine of claim 6, wherein the desired pressure range is between 0 kPa-g and about 35 kPa-g and the desired mass flow rate range is between about 10 kg/hour and about 300 kg/hour.

9. The internal combustion engine of claim 6, wherein the auxiliary device is mounted to the internal combustion engine, and wherein the air is passed through a heat exchanger prior to the air entering the crankcase.

10. The internal combustion engine of claim 6, further comprising a heat exchanger, wherein one of: the heat exchanger receives the air from the auxiliary device prior to the air entering the crankcase or the heat exchanger receives the air from ambient and passes the air to the auxiliary device.

11. A ventilation system for supplying air to a crankcase of an internal combustion engine, the system comprising:

an engine block defining a combustion chamber and the crankcase in fluid communication with the combustion chamber;

an inlet configured to filter air from an ambient source; and an auxiliary device in fluid communication with the inlet and the crankcase of the engine block, wherein the auxiliary device is driven by the internal combustion engine to supply air to the crankcase of the engine block at a desired pressure range and a desired mass flow rate range to ventilate the crankcase, wherein the auxiliary device includes a turbine wheel that is driven by a boost air from the internal combustion engine.

12. The system of claim 11, further comprising a heat exchanger, wherein one of: the heat exchanger receives the air from the auxiliary device prior to the air entering the crankcase or the heat exchanger receives the air from ambient and passes the air to the auxiliary device.

13. The system of claim 11, wherein the auxiliary device includes the turbine wheel and a compressor wheel coupled together as an assembly.

14. The system of claim 11, wherein the auxiliary device includes a compressor wheel coupled to the turbine wheel and rotated thereby to compress the air from the ambient source.

15. The system of claim 11, wherein the desired pressure range is between 0 kPa-g and about 35 kPa-g and the desired mass flow rate range is between about 10 kg/hour and about 300 kg/hour.

16. The system of claim 11, wherein the auxiliary device is configured to mount to a breather support of the crankcase.

17. A ventilation system for supplying air to a crankcase of an internal combustion engine, the system comprising:

an engine block defining a combustion chamber and the crankcase in fluid communication with the combustion chamber;

an inlet configured to filter air from an ambient source; and an auxiliary device in fluid communication with the inlet and the crankcase of the engine block, wherein the auxiliary device is driven by the internal combustion engine to supply air to the crankcase of the engine block at a desired pressure range and a desired mass flow rate range to ventilate the crankcase, wherein the auxiliary device includes a component that is driven by a lube oil of the internal combustion engine.

18. The system of claim 17, wherein the component is one of a wheel or a gear.

19. The system of claim 17, wherein the desired pressure range is between 0 kPa-g and about 35 kPa-g and the desired mass flow rate range is between about 10 kg/hour and about 300 kg/hour.

20. The system of claim 17, wherein the auxiliary device is configured to mount to a breather support of the crankcase.

* * * * *